US010676320B2

(12) United States Patent
Mitsui

(10) Patent No.: US 10,676,320 B2
(45) Date of Patent: Jun. 9, 2020

(54) ELEVATOR ROPE AND A MANUFACTURING METHOD THEREFOR

(71) Applicant: MITSUBISHI ELECTRIC CORPORATION, Chiyoda-ku (JP)

(72) Inventor: Atsushi Mitsui, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 43 days.

(21) Appl. No.: 15/750,553

(22) PCT Filed: Oct. 16, 2015

(86) PCT No.: PCT/JP2015/079309
§ 371 (c)(1),
(2) Date: Feb. 6, 2018

(87) PCT Pub. No.: WO2017/064808
PCT Pub. Date: Apr. 20, 2017

(65) Prior Publication Data

US 2018/0362300 A1 Dec. 20, 2018

(51) Int. Cl.
*B66B 7/06* (2006.01)
*D07B 1/06* (2006.01)
(Continued)

(52) U.S. Cl.
CPC ..... *B66B 7/068* (2013.01); *B66B 7/06* (2013.01); *D07B 1/005* (2013.01); *D07B 1/0686* (2013.01);
(Continued)

(58) Field of Classification Search
CPC ..... B66B 7/068; B66B 7/06; D07B 1/0686; D07B 1/005; D07B 1/165;
(Continued)

(56) References Cited

U.S. PATENT DOCUMENTS 4,095,404 A * 6/1978 Babayan ..... D06M 15/564 57/292
4,226,078 A * 10/1980 Ohta ..... D07B 1/068 57/213
(Continued)

FOREIGN PATENT DOCUMENTS

EP 2 441 723 A1 4/2012
EP 2 634 130 A1 9/2013
(Continued)

OTHER PUBLICATIONS

"Kevlar Technical Guide." DUPONT, www.dupont.com/content/dam/dupont/products-and-services/fabrics-fibers-and-nonwovens/fibers/documents/Kevlar_Technical_Guide.pdf. (Year: 2017).*
(Continued)

*Primary Examiner* — Khoa D Huynh
*Assistant Examiner* — Grace Huang
(74) *Attorney, Agent, or Firm* — Xsensus LLP

(57) ABSTRACT

In an elevator rope, an inner layer rope includes a fiber core that includes a. bundle of fibers; a plurality of inner layer rope strands that each include a plurality of steel wires are disposed around an outer circumference of the fiber core; and a resin inner layer rope coating body that is coated around an outer circumference of the fiber core and a layer of the inner layer rope strands. A plurality of outer layer strands each including a plurality of steel wires are disposed around an outer circumference of the inner layer rope coating body.

16 Claims, 3 Drawing Sheets

(51) Int. Cl.
*D07B 1/00* (2006.01)
*D07B 1/16* (2006.01)

(52) U.S. Cl.
CPC ..... *D07B 1/165* (2013.01); *D07B 2201/102* (2013.01); *D07B 2201/1016* (2013.01); *D07B 2201/1036* (2013.01); *D07B 2201/2009* (2013.01); *D07B 2201/2038* (2013.01); *D07B 2201/2055* (2013.01); *D07B 2201/2056* (2013.01); *D07B 2201/2065* (2013.01); *D07B 2201/2066* (2013.01); *D07B 2201/2068* (2013.01); *D07B 2201/2087* (2013.01); *D07B 2205/205* (2013.01); *D07B 2205/2096* (2013.01); *D07B 2205/3007* (2013.01); *D07B 2205/3025* (2013.01); *D07B 2501/2007* (2013.01)

(58) Field of Classification Search
CPC .... D07B 2201/2056; D07B 2201/1016; D07B 2201/2066; D07B 2201/102; D07B 2201/1036; D07B 2201/2009; D07B 2201/2038; D07B 2501/2007; D07B 2201/2087; D07B 2205/2096; D07B 2205/3007; D07B 2205/3025; D07B 2201/2068; D07B 2201/2065; D07B 2201/2055; D07B 5/005; D07B 5/006; D07B 7/12; D07B 7/14; B65H 81/06
USPC ..... 57/7, 211, 216, 217, 221, 222, 223, 232, 57/258
See application file for complete search history.

(56) References Cited

U.S. PATENT DOCUMENTS 4,288,977 A * 9/1981 Csaky ..... D01H 13/30 57/248
4,820,012 A * 4/1989 Asai ..... G02B 6/4416 174/113 C
7,137,483 B2 * 11/2006 Kato ..... B66B 7/06 187/251
9,162,849 B2 * 10/2015 Mitsui ..... B66B 7/06
9,309,620 B2 * 4/2016 Amils ..... D07B 1/068
9,315,363 B2 * 4/2016 Aulanko ..... B66B 7/06
9,315,938 B2 * 4/2016 Aulanko ..... B66B 7/06
9,902,594 B2 * 2/2018 Mitsui ..... D07B 1/0673
2007/0102183 A1 * 5/2007 Jotti ..... B29C 48/705 174/68.1
2012/0297746 A1 * 11/2012 Chou ..... D07B 1/02 57/230
2012/0312444 A1 * 12/2012 Domingo ..... D02G 3/48 152/556
2014/0311119 A1 10/2014 Mitsui
2015/0144432 A1 * 5/2015 Mitsui ..... D07B 1/0673 187/254
2015/0247285 A1 * 9/2015 Amils ..... D07B 1/16 57/221
2017/0129742 A1 * 5/2017 Hong ..... B66B 7/06

FOREIGN PATENT DOCUMENTS

EP 2634130 A1 * 9/2013 ..... B66B 7/06
JP 53-122842 10/1978
JP 4-44397 U 4/1992
JP 10140490 A 5/1998
JP 5478718 B2 4/2014
KR 10-2014-0116468 A 10/2014
WO 2010/143249 A1 12/2010
WO 2012/056529 A1 5/2012
WO 2014/033853 A1 3/2014

OTHER PUBLICATIONS

International Search Report dated Jan. 19, 2016 in PCT/JP2015/079309 filed Oct. 16, 2015.
KIPO Notification of Reason for Refusal dated Apr. 23, 2019, issued in corresponding Korean Application No. 10-2018-7008473, 11 pages (with English Translation).
Notice of Final Rejection dated Dec. 9, 2019, issued in corresponding Korean Application No. 10-2018-7008473, 8 pages (with English translation).

* cited by examiner

ELEVATOR ROPE AND A MANUFACTURING METHOD THEREFOR

TECHNICAL FIELD

The present invention relates to an elevator rope that can be used as a main rope that suspends a car, for example, and to a manufacturing method therefor.

BACKGROUND ART

In recent years, increases to ultrahigh speeds and increases to ultrahigh lifting ranges in elevators are advancing rapidly. In such ultrahigh-speed elevators that have ultrahigh lifting ranges, the diameters and lengths of the ropes that are used is increased, increasing the rope mass ratio in an axle load that acts on a hoisting machine. Some problems in adapting to increases in acting loads have included increasing equipment size and ensuring rope safety factor.

In answer to that, in conventional hybrid ropes, a plurality of steel strands are twisted together around an outer circumference of a high-strength synthetic fiber core. The strength contribution of the fiber portion is increased by the lay pitch of the rope. In addition, a woven fiber sleeve is disposed around the outer circumference of the high-strength synthetic fiber core, such that the sleeve contracts radially when a tensile load acts on the entire rope. Compressive forces thereby arise in the high-strength synthetic fiber core, stabilizing the shape of the rope (see Patent Literature 1, for example).

CITATION LIST

Patent Literature

[Patent Literature 1]
Japanese Patent No. 5478718 (Gazette)

SUMMARY OF THE INVENTION

Problem to be Solved by the Invention

In conventional hybrid ropes such as that described above, structural gaps that arise due to bundling the synthetic fiber core could not be reduced sufficiently. Merits of the synthetic fiber core, which has a high strength-to-mass ratio strength, were also not exerted sufficiently. In addition, because manufacturing the resin sleeve takes an excessive amount of time, another problem has been that it is difficult to apply them to long elevator ropes that have large numbers of strands, from a viewpoint of cost.

The present invention aims to solve the above problems and an object of the present invention is to provide an elevator rope and a manufacturing method therefor that can reduce structural gaps inside a fiber core sufficiently by a simple configuration.

Means for Solving the Problem

An elevator rope according to the present invention includes: an inner layer rope including: a fiber core that is constituted by a bundle of fibers; a plurality of inner layer rope strands that each include a plurality of steel wires, and that are disposed around an outer circumference of the fiber core; and a resin inner layer rope coating body that is coated around an outer circumference of the fiber core and a layer of the inner layer rope strands; and a plurality of outer layer strands that each include a plurality of steel wires, and that are disposed around an outer circumference of the inner layer rope coating body.

An elevator rope manufacturing method according to the present invention includes: a step of twisting together a plurality of inner layer rope strands that each include a plurality of steel wires around an outer circumference of a fiber core that is constituted by a bundle of fibers; a step of coating a resin inner layer rope coating body around an outer circumference of the fiber core and a layer of the inner layer rope strands; and a step of twisting together a plurality of outer layer strands that each include a plurality of steel wires around an outer circumference of the inner layer rope coating body.

Effects of the Invention

An elevator rope and a manufacturing method therefor according to the present invention can reduce structural gaps inside a fiber core sufficiently by a simple configuration.

DESCRIPTION OF EMBODIMENTS

Preferred embodiments of the present invention will now be explained with reference to the drawings.

Embodiment 1

Figure 1:
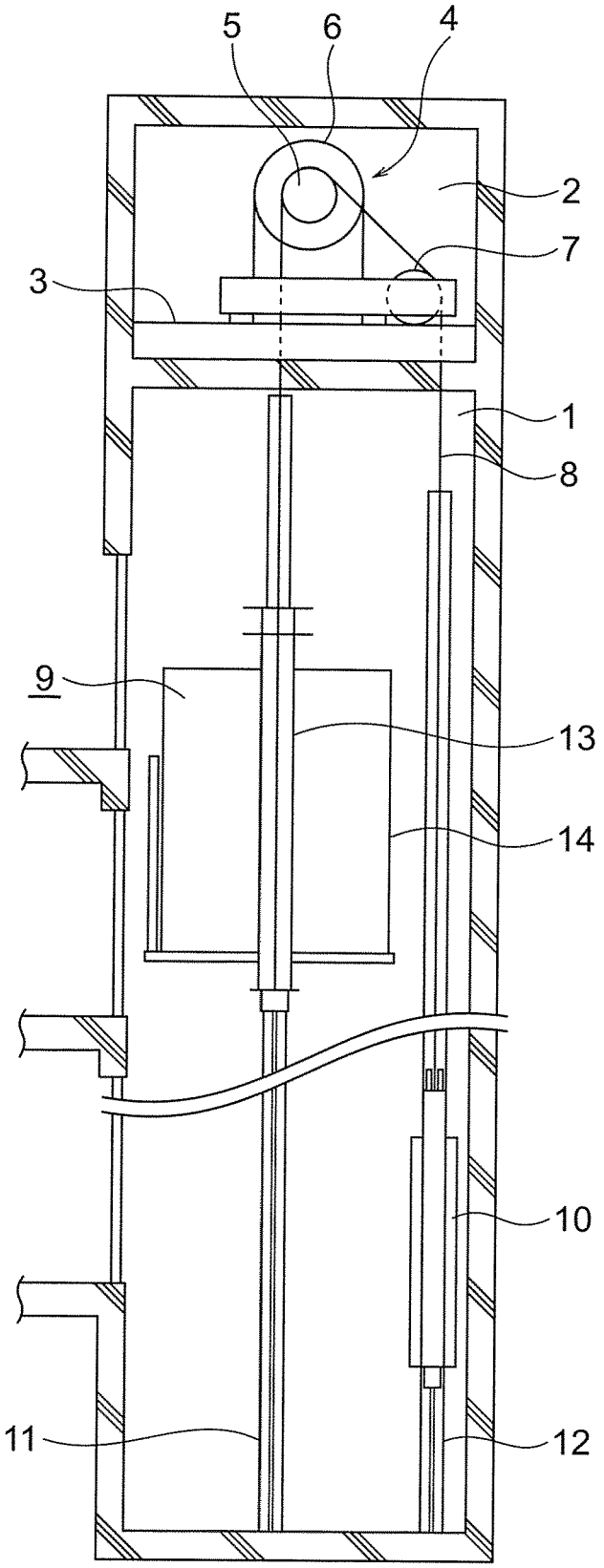
FIG. 1 is a side elevation that shows an elevator apparatus according to Embodiment 1 of the present invention.

FIG. 1 is a side elevation that shows an elevator apparatus according to Embodiment 1 of the present invention. In the figure, a machine room 2 is disposed in an upper portion of a hoistway 1. A machine base 3 is installed inside the machine room 2. A hoisting machine 4 is supported on the machine base 3. The hoisting machine 4 has a driving sheave 5 and a hoisting machine main body 6. The hoisting machine main body 6 has: a hoisting machine motor that rotates the driving sheave 5; and a hoisting machine brake that brakes the rotation of the driving sheave 5.

A deflecting sheave 7 is mounted onto the machine base 3. A plurality of elevator ropes 8 (only one is shown in the figure) are wound around the driving sheave 5 and the deflecting sheave 7. A plurality of rope grooves (not shown) into which the elevator ropes 8 are inserted are formed around an outer circumference of the driving sheave 5.

A car 9 is connected to first end portions of the elevator ropes 8. A counterweight 10 is connected to second end portions of the elevator ropes 8. The car 9 and the counterweight 10 are suspended by the elevator ropes 8, and are raised and lowered inside the hoistway 1 by rotating the driving sheave 5.

A pair of car guide rails 11 that guide raising and lowering of the car 9 and a pair of counterweight guide rails 12 that guide raising and lowering of the counterweight 10 are installed inside the hoistway 1.

The car 9 has: a car frame 13 to which the elevator ropes 8 are connected; and a cage 14 that is supported by the car frame 13.

Figure 2:
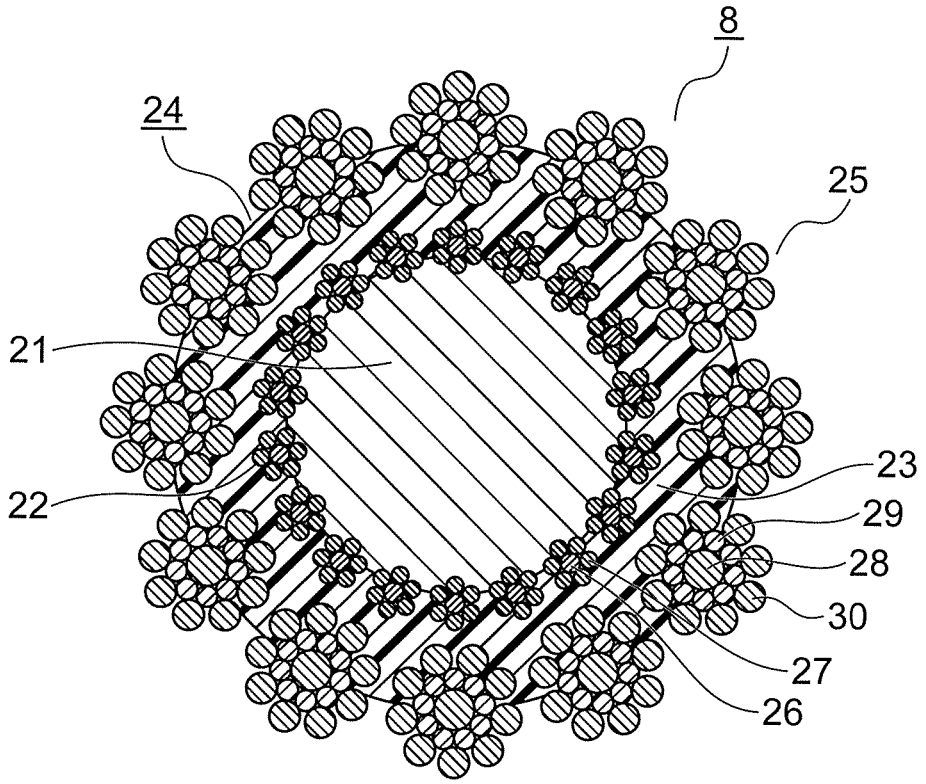
FIG. 2 is a cross section of an elevator rope from FIG. 1.

FIG. 2 is a cross section of an elevator rope 8 from FIG. 1, and represents a cross section that is perpendicular to a longitudinal direction. A high-strength synthetic fiber core 21 is disposed centrally in the elevator rope 8. The high-strength synthetic fiber core 21 is constituted by a bundle of high-strength synthetic fiber material such as aramid fibers, polyparaphenylene benzobisoxazole (PBO) fibers, or carbon fibers. Tensile strength of the material that constitutes the high-strength synthetic fiber core 21, i.e., the strength per unit area of the cross section of the high-strength synthetic fiber core 21, is greater than or equal to 3,000 MPa, which is higher than that of steel wire that is used in steel rope.

In addition, the high-strength synthetic fiber core 21 is not in a rope form in which a plurality of strands are twisted, but rather in a strand form in which fibers are bundled. A "strand form" is a state in which fibers are simply bundled, or a state in which a plurality of fiber bundles that constitute a constitutional unit of a strand are twisted together.

A plurality of (in this case, eighteen) inner layer rope strands 22 are disposed around an outer circumference of the high-strength synthetic fiber core 21 so as to be twisted together. An outer circumference of the high-strength synthetic fiber core 21 and the layer of inner layer rope strands 22 is coated by a resin inner layer rope coating body 23. An inner layer rope 24 includes the high-strength synthetic fiber core 21, the inner layer rope strands 22, and the inner layer rope coating body 23.

A plurality of (in this case, twelve) outer layer strands 25 are disposed around an outer circumference of the inner layer rope coating body 23 so as to be twisted together. The outer layer strands 25 are positioned on an outermost layer of the elevator rope 8 so as to be exposed externally.

Diameters of each of the inner layer rope strands 22 are smaller than diameters of each of the outer layer strands 25, being approximately one half or less. Furthermore, the inner layer rope strands 22 are greater in number than the outer layer strands 25. In other words, the outer layer strands 25 are lower in number than the inner layer rope strands 22.

The inner layer rope coating body 23 is interposed between the layer of inner layer rope strands 22 and the layer of outer layer strands 25. The inner layer rope coating body 23 also enters between adjacent inner layer rope strands 22 and between adjacent outer layer strands 25. A resin that has a certain amount of hardness, such as polyethylene or polypropylene, for example, is used as a material for the inner layer rope coating body 23.

Each of the inner layer rope strands 22 is configured by twisting together a plurality of steel wires. More specifically, each of the inner layer rope strands 22 has a two-layer construction that has: an inner layer rope strand core wire 26 that is disposed centrally; and a plurality of (in this case, six) inner layer rope strand outer layer wires 27 that are disposed so as to be twisted together around an outer circumference of the inner layer rope strand core wire 26. A diameter of the inner layer rope strand core wire 26 is similar or identical to a diameter of the inner layer rope strand outer layer wires 27.

Each of the outer layer strands 25 is configured by twisting together a plurality of steel wires. More specifically, each of the outer layer strands 25 has a three-layer construction that has: an outer layer strand core wire 28 that is disposed centrally; a plurality of outer layer strand intermediate wires 29 that are disposed so as to be twisted together around an outer circumference of the outer layer strand core wire 28; and a plurality of outer layer strand outer layer wires 30 that are disposed so as to be twisted together around an outer circumference of the layer of outer layer strand intermediate wires 29.

The outer layer strand intermediate wires 29 are equal in number to the outer layer strand outer layer wires 30 (in this case, nine of each). A diameter of the outer layer strand core wires 28 is greater than a diameter of the outer layer strand outer layer wires 30. A diameter of the outer layer strand intermediate wires 29 is smaller than the diameter of the outer layer strand outer layer wires 30.

The diameters of the wires 26 and 27 that constitute the inner layer rope strands 22 are smaller than the diameters of any wire among the wires 28, 29, and 30 that constitute the outer layer strands 25. The tensile strength of the wires 26 and 27 that constitute the inner layer rope strands 22 is also greater than or equal to the tensile strength of the wire that has the greatest tensile strength among the wires 28, 29, and 30 that constitute the outer layer strands 25. Here, the tensile strength of the wires is the strength when each wire is pulled individually.

The disposable cross-sectional area of the high-strength synthetic fiber core 21 compared to the steel wire portions that are included in the elevator rope 8, i.e., the total cross-sectional area of the inner layer rope strands 22 and the outer layer strands 25, is greater than or equal to forty percent. The strength contribution ratio of the portion in the high-strength synthetic fiber core 21 compared to the elevator rope 8 as a whole is also greater than or equal to twenty percent.

When manufacturing an elevator rope of this kind, the inner layer rope strands 22 are first twisted together around the outer circumference of the high-strength synthetic fiber core 21. Next, the inner layer rope coating body 23 is coated around the outer circumference of the high-strength synthetic fiber core 21 and the layer of inner layer rope strands 22. The outer layer strands 25 are then twisted together around the outer circumference of the inner layer rope coating body 23.

Now, since conventional high-strength synthetic fiber cores are configured into bundles by twisting or aligning large numbers of fibers, and structural gaps exist between each of the fiber strands and between each of the fibers, if the high-strength synthetic fiber cores are used as ropes on their own, it is necessary to apply extensive stretching in order to bring the high-strength properties of the material into play. Because of that, the high-strength synthetic fiber cores are less likely to contribute to the overall strength burden of the rope if high-strength synthetic fiber cores to which stretching has not been applied are used in combination with steel strands.

In answer to that, in the elevator rope 8 according to Embodiment 1, because the inner layer rope strands 22 are disposed around the outer circumference of the high-strength synthetic fiber cores 21, the central high-strength synthetic fiber core 21 can be clamped by the inner layer rope strands 22 during manufacturing of the inner layer rope 24, enabling gaps that exist inside the high-strength synthetic fiber core 21 to be reduced. Furthermore, because the outer layer strands 25 are disposed around the outer circumference of the inner layer rope 24, the high-strength synthetic fiber core 21 can also be clamped by the outer layer strands 25, enabling the actual packing density of the fibers in the high-strength synthetic fiber core 21 to be further improved.

Twisting the outer layer strands 25 together around the outer circumference of the high-strength synthetic fiber core 21 directly without the inner layer rope strands 22 is also conceivable, but because it is necessary to increase the amount of deformation in the high-strength synthetic fiber core 21 in order to reduce the gaps in the high-strength synthetic fiber core 21 sufficiently in a single step, a large pressing force (compressive force) is required, and there is a risk that the outer layer strands 25 may be damaged or deformed, or that the outer circumference of the high-strength synthetic fiber core 21 may be damaged.

In contrast to that, in Embodiment 1, pressure can be distributed by using many inner layer rope strands 22. Furthermore, the step of clamping the high-strength synthetic fiber core 21 is divided between a step of twisting together the inner layer rope 24 and a step of twisting together the outer layer strands 25, enabling the clamping force on the high-strength synthetic fiber core 21 to be distributed into two steps. Because of that, the outer layer strands 25 can be prevented from being damaged or deformed, and the outer circumference of the high-strength synthetic fiber core 21 prevented from being damaged.

In this manner, in the elevator rope according to Embodiment 1, structural gaps inside a fiber core can be reduced sufficiently by a simple configuration while using a high-strength synthetic fiber core 21.

Because the inner layer rope coating body 23 is disposed around the outer circumference of the inner layer rope 24, not only can structural gaps in the inner layer rope 24 be reduced significantly compared to conventional fiber core ropes, but direct contact between the inner layer rope strands 22 and the outer layer strands 25 can also be prevented, enabling decreases in diameter due to deformation (loss of resilience) and abrasion of the inner layer rope 24 over extensive periods of use to be prevented. Furthermore, increases in abrasion of the wires 28, 29, and 30 due to increases in contact pressure among the outer layer strands 25 can be suppressed.

In addition, because the steel outer layer strands 25 are disposed around the outermost circumference, which is the portion that comes into contact with the rope grooves of the driving sheave 5 and on which frictional forces act, wear resistance can be maintained in a similar or identical manner to conventional steel ropes, making it unnecessary to be concerned about extreme deterioration in strength due to friction.

By making the diameters of the inner layer rope strands 22 significantly smaller than the diameters of the outer layer strands 25 while making the inner layer rope strands 22 greater in number than the outer layer strands 25, area in the inner layer rope 24 occupied by the high-strength synthetic fiber core 21 portion can be increased.

By minimizing the diameters of the outer layer strands 25 while increasing outer layer strands 25 in number, area in the elevator rope 8 that is occupied by the high-strength synthetic fiber core 21 portion can be increased.

As a specific example, by giving twelve outer layer strands 25 a parallel lay construction, making the inner layer rope strands 22 eighteen in number, and making the wires 26 and 27 in each of the inner layer rope strands 22 seven in number, as shown in FIG. 2, the disposable cross-sectional area of the high-strength synthetic fiber core 21 can be ensured to be greater than or equal to forty percent compared to the effective cross-sectional area of the steel wire portion.

In addition, because the diameters of the wires 26 and 27 that constitute the inner layer rope strands 22 are made to be smaller than the diameters of any wire among the wires 28, 29, and 30 that constitute the outer layer strands 25, stresses that arise in the wires 26 and 27 of the inner layer rope strands 22 during bending can be reduced. Moreover, because the tensile strength of the wires 26 and 27 that constitute the inner layer rope strands 22 is made to be greater than or equal to the tensile strength of the wire that has the greatest tensile strength among the wires 28, 29, and 30 that constitute the outer layer strands 25, the wires 28, 29, and 30 of the outer layer strands 25 will break prior to the wires 26 and 27 of the inner layer rope strands 22. Consequently, even if the wire breakage state of the inner layer rope strands 22 cannot be checked during inspections, appropriate replacement decisions can be made from the wire breakage state of the outer layer strands 25, which are easy to check.

Furthermore, core ropes that are used in conventional ropes with fiber cores have a construction that is called "three-strand" in which three core rope strands are bundled together, a large number of fibers being bundled into each core rope strand. Such constructions are most suitable in ropes in which the fiber core is not made to bear a strong load because flexibility is high, and suitable gaps can be ensured internally. However, it is desirable for the high-strength synthetic fiber core 21 to be applied to a configuration called "single-strand" that has only one strand because the effects of the elevator rope 8 according to Embodiment 1 are increased by the high-strength synthetic fiber core 21 bearing a strong load.

Embodiment 2

Figure 3:
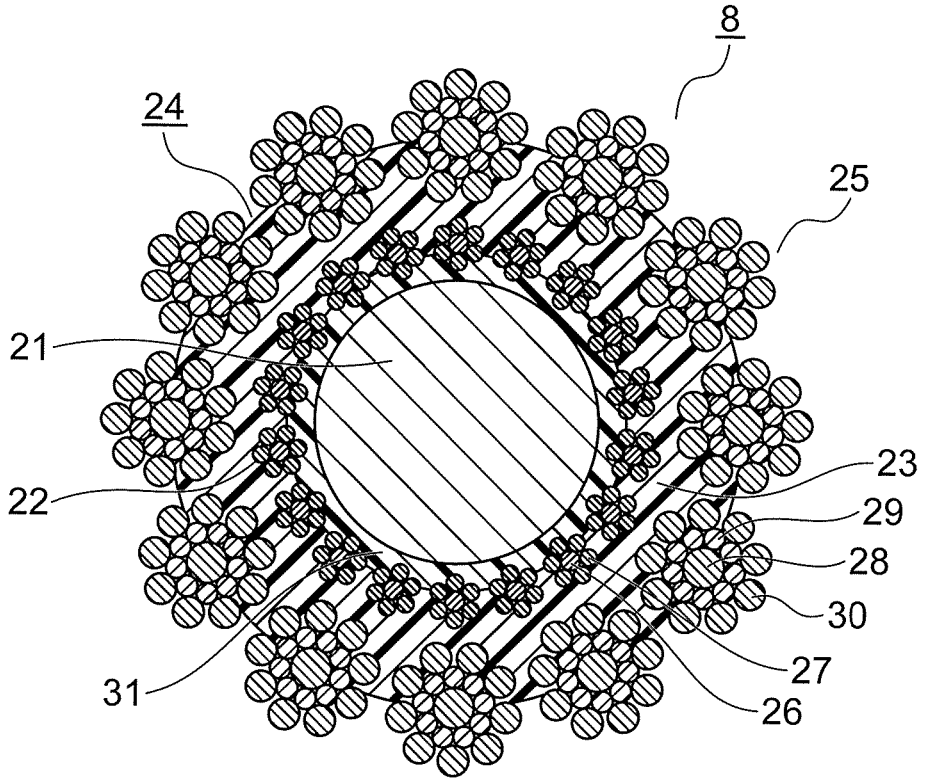
FIG. 3 is a cross section of an elevator rope according to Embodiment 2 of the present invention.

Next, FIG. 3 is a cross section of an elevator rope 8 according to Embodiment 2 of the present invention. In Embodiment 2, an outer circumference of a high-strength synthetic fiber core 21 is coated by a resin fiber core coating body 31. Inner layer rope strands 22 are disposed around an outer circumference of the fiber core coating body 31 so as to be twisted together. In other words, the fiber core coating body 31 is interposed between the high-strength synthetic fiber core 21 and the inner layer rope strands 22. Furthermore, a material of the fiber core coating body 31 is identical to a material of the inner layer rope coating body 23.

When manufacturing an elevator rope 8 of this kind, the fiber core coating body 31 is coated onto the outer circumference of the high-strength synthetic fiber core 21 before twisting the inner layer rope strands 22 together around the outer circumference of the high-strength synthetic fiber core 21. The rest of the configuration and the manufacturing method are similar or identical to that of Embodiment 1.

Using a configuration of this kind, fiber damage due to relative slippage between the inner layer rope strands 22 and the high-strength synthetic fiber core 21 when bending acts on the elevator rope 8 can be prevented, enabling deterioration in service life of the fiber portion over extensive periods of use to be suppressed.

In order to prevent the synthetic fiber core from melting in the coating process when the fiber core coating body 31 is coated onto the high-strength synthetic fiber core 21, it is preferable to use a material that has an extremely high melting point, such as aramid fibers, PBO fibers, or carbon fibers, for example, or a material that has no clear melting point, as the material for the high-strength synthetic fiber core 21.

Moreover, the material of the fiber core coating body 31 may be different than the material of the inner layer rope coating body 23.

The type of elevator to which the elevator rope according to the present invention is applied is not limited to the type in FIG. 1. The present invention can also be applied to machine-roomless elevators, to elevator apparatuses that use two-to-one (2:1) roping methods, to multi-car elevators, or to double-deck elevators, for example.

In addition, the elevator rope according to the present invention can also be applied to ropes other than ropes for suspending a car 9, such as compensating ropes or governor ropes, for example.

The invention claimed is:

1. An elevator rope comprising:

an inner layer rope comprising:

a fiber core that includes a bundle of fibers;

a resin fiber core coating body on an outer circumference of the fiber core;

a plurality of inner layer rope strands that each include a plurality of steel wires, and that are disposed around an outer circumference of the resin fiber core coating body;

a resin inner layer rope coating body that is coated around an outer circumference of the resin fiber core coating body and a layer of the inner layer rope strands; and a plurality of outer layer strands that each include a plurality of steel wires, and that are disposed around an outer circumference of the inner layer rope coating body, wherein the inner layer rope strands are greater in number than the outer layer strands.

2. An elevator rope comprising:

an inner layer rope comprising:

a fiber core that includes a bundle of fibers;

a resin fiber core coating body on an outer circumference of the fiber core;

a plurality of inner layer rope strands that each include a plurality of steel wires, and that are disposed around an outer circumference of the resin fiber core coating body;

a resin inner layer rope coating body that is coated around an outer circumference of the resin fiber core coating body and a layer of the inner layer rope strands; and a plurality of outer layer strands that each include a plurality of steel wires, and that are disposed around an outer circumference of the inner layer rope coating body, wherein a diameter of each of the inner layer rope strands is smaller than a diameter of each of the outer layer strands.

3. The elevator rope according to claim 1, wherein a diameter of the inner layer rope strands is smaller than a diameter of any individual wire among the plurality of steel wires of the outer layer strands.

4. The elevator rope according to claim 1, wherein a tensile strength of the inner layer rope strands is greater than or equal to a tensile strength of a wire that has greatest tensile strength among the plurality of individual steel wires of the outer layer strands.

5. The elevator rope according to claim 1, wherein a disposable cross-sectional area of the fiber core is greater than or equal to forty percent relative to a cross-sectional area of a steel wire portion which includes the plurality of steel wires of the inner layer rope strands and the plurality of steel wires of the outer layer strands.

6. The elevator rope according to claim 1, wherein a strength contribution ratio of the fiber core compared to the rope as a whole is greater than or equal to twenty percent.

7. An elevator rope manufacturing method comprising:

coating a resin fiber core coating body on an outer circumference of a fiber core that includes a bundle of fibers:

twisting together a plurality of inner layer rope strands that each include a plurality of steel wires around an outer circumference of the resin fiber core coating body;

coating a resin inner layer rope coating body around an outer circumference of the resin fiber core coating body and a layer of the inner layer rope strands; and twisting together a plurality of outer layer strands that each include a plurality of steel wires around an outer circumference of the inner layer rope coating body, wherein the inner layer rope strands are greater in number than the outer layer strands.

8. The elevator rope according to claim 1, wherein a diameter of each of the inner layer rope strands is smaller than a diameter of each of the outer layer strands.

9. The elevator rope according to claim 2, wherein a diameter of the inner layer rope strands is smaller than a diameter of any individual wire among the plurality of steel wires of the outer layer strands.

10. The elevator rope according to claim 8. wherein a diameter of the inner layer rope strands is smaller than a diameter of any individual wire among the plurality of steel wires of the outer layer strands.

11. The elevator rope according to claim 2, wherein a tensile strength of the inner layer rope strands is greater than or equal to a tensile strength of a wire that has greatest tensile strength among the plurality of individual steel wires of the outer layer strands.

12. The elevator rope according to claim 3, wherein a tensile strength of the inner layer rope strands is greater than or equal to a tensile strength of a. wire that has greatest tensile strength among the plurality of individual steel wires of the outer layer strands.

13. The elevator rope according to claim 9, wherein a tensile strength of the of the inner layer rope strands is greater than or equal to a tensile strength of a wire that has greatest tensile strength among the plurality of individual steel wires of the outer layer strands.

14. The elevator rope according to claim 1, wherein:

a strength of a material of the fiber core is greater than or equal to 3,000 MPa.

15. The method according to claim 7, wherein:

a strength of a material of the fiber core is greater than or equal to 3,000 MPa.

16. The elevator rope according to claim 2, wherein:

a strength of a material of the fiber core is greater than or equal to 3,000 MPa.

* * * * *